US006332969B1

(12) United States Patent
Ray et al.

(10) Patent No.: US 6,332,969 B1
(45) **Date of Patent: *Dec. 25, 2001**

(54) INERT ELECTRODE CONTAINING METAL OXIDES, COPPER AND NOBLE METAL

(75) Inventors: Siba P. Ray, Murrysville; Robert W. Woods, New Kensington; Robert K. Dawless, Monroeville; Robert B. Hosler, Sarver, all of PA (US)

(73) Assignee: Alcoa Inc., Pittsburgh, PA (US)

( * ) Notice: Subject to any disclaimer, the term of this patent is extended or adjusted under 35 U.S.C. 154(b) by 0 days.

This patent is subject to a terminal disclaimer.

(21) Appl. No.: 09/621,728

(22) Filed: Jul. 24, 2000

Related U.S. Application Data

(63) Continuation of application No. 09/241,518, filed on Feb. 1, 1999, now Pat. No. 6,126,799, which is a continuation-in-part of application No. 08/883,061, filed on Jun. 26, 1997, now Pat. No. 5,865,980.

(51) Int. Cl.[7] ..... C25B 1/02

(52) U.S. Cl. ..... 205/362; 205/354; 205/357; 205/483; 205/484; 205/538; 205/543; 205/544; 205/545; 204/291; 204/292; 204/293; 204/243.1; 204/247.3; 148/679

(58) Field of Search ..... 205/483, 484, 205/538, 543, 544, 545, 354, 357, 362; 204/292, 293, 243.1, 247.3, 291; 148/679

(56) References Cited

U.S. PATENT DOCUMENTS

| | | | | |
|---|---|---|---|---|
| 4,397,729 | | 8/1983 | Duruz et al. | 204/243 |
| 4,552,630 | | 11/1985 | Wheeler et al. | 204/67 |
| 4,620,905 | | 11/1986 | Tarcy et al. | 204/64 |
| 4,871,438 | | 10/1989 | Marschman et al. | 204/29 |
| 5,019,225 | | 5/1991 | Darracq et al. | 204/67 |
| 5,794,112 | * | 8/1998 | Ray et al. | 419/21 |
| 5,865,980 | * | 2/1999 | Ray et al. | 204/293 |
| 6,126,799 | * | 10/2000 | Ray et al. | 204/293 |

FOREIGN PATENT DOCUMENTS 0030834 6/1989 (EP) .

* cited by examiner

*Primary Examiner*—Bruce F. Bell
(74) *Attorney, Agent, or Firm*—Glenn E. Klepac

(57) ABSTRACT

A cermet composite material is made by treating at an elevated temperature a mixture comprising a compound of iron and a compound of at least one other metal, together with an alloy or mixture of copper and a noble metal. The alloy or mixture preferably comprises particles having an interior portion containing more copper than noble metal and an exterior portion containing more noble metal than copper. The noble metal is preferably silver. The cermet composite material preferably includes alloy phase portions and a ceramic phase portion. At least part of the ceramic phase portion preferably has a spinel structure.

20 Claims, 3 Drawing Sheets

INERT ELECTRODE CONTAINING METAL OXIDES, COPPER AND NOBLE METAL

CROSS REFERENCE TO RELATED APPLICATION

This application is a continuation of U.S. Ser. No. 09/241,518, filed Feb. 1, 1999, now U.S. Pat. No. 6,126,799 which is a continuation-in-part of U.S. Ser. No. 08/883,061, filed Jun. 26, 1997, now U.S. Pat. 5,865,980, issued Feb. 2, 1999.

This invention was made with Government support under Contract No. DE-FC07-981 D 1366 awarded by the Department of Energy. The Government has certain rights in this invention.

FIELD OF THE INVENTION

The present invention relates to the electrolytic production of metals such as aluminum. More particularly, the invention relates to electrolysis in a cell having an inert electrode comprising at least two metal oxides, copper and a noble metal.

BACKGROUND OF THE INVENTION

The energy and cost efficiency of aluminum smelting can be significantly reduced with the use of inert, non-consumable and dimensionally stable anodes. Replacement of traditional carbon anodes with inert anodes should allow a highly productive cell design to be utilized, thereby reducing capital costs. Significant environmental benefits are also possible because inert anodes produce no $CO_2$ or $CF_4$ emissions. The use of a dimensionally stable inert anode together with a wettable cathode also allows efficient cell designs and a shorter anode-cathode distance, with consequent energy savings.

The most significant challenge to the commercialization of inert anode technology is the anode material. Researchers have been searching for suitable inert anode materials since the early years of the Hall-Heroult process. The anode material must satisfy a number of very difficult conditions. For example, the material must not react with or dissolve to any significant extent in the cryolite electrolyte. It must not react with oxygen or corrode in an oxygen-containing atmosphere. It should be thermally stable at temperatures of about 1000° C. It must be relatively inexpensive and should have good mechanical strength. It must have high electrical conductivity at the smelting cell operating temperature, about 950–970° C., so that the voltage drop at the anode is low. In addition, aluminum produced with the inert anodes should not be contaminated with constituents of the anode material to any appreciable extent.

A principal objective of our invention is to provide an efficient and economic process for making an inert electrode material, starting with a reaction mixture comprising compounds of iron and at least one other metal, copper and a noble metal.

A related objective of our invention is to provide a novel inert electrode comprising ceramic phase portions and alloy phase portions, wherein interior portions of the alloy phase portions contain more copper than noble metal and exterior portions of the alloy phase portions contain more noble metal than copper.

Some other objectives of our invention are to provide an electrolytic cell and an electrolytic process for producing metal, utilizing the novel inert electrode of the invention.

Additional objectives and advantages of our invention will occur to persons skilled in the art from the following detailed description thereof

SUMMARY OF THE INVENTION

The present invention relates to a process for making an inert electrode and to an electrolytic cell and an electrolytic process for producing metal utilizing the inert electrode. Inert electrodes containing the composite material of our invention are useful in producing metals such as aluminum, lead, magnesium, zinc, zirconium, titanium, lithium, calcium, silicon and the like, generally by electrolytic reduction of an oxide or other salt of the metal.

In accordance with our invention, a starting mixture is treated in a gaseous atmosphere at an elevated temperature. The mixture comprises particles containing compounds of at least two different metals and an alloy or mixture of copper and a noble metal. The compounds are preferably oxides and more preferably iron oxide and at least one other metal oxide which may be nickel, tin, zinc, yttrium, zirconium, chromium, or tantalum oxide. Nickel, zinc, and chromium oxides are preferred. Other suitable compounds of the metals include metal salts that are converted to oxides when exposed to oxygen at elevated temperatures. Such salts include the halides, carbonates, nitrates, sulfates and acetates.

The noble metal may be silver, gold, platinum, palladium, rhodium, iridium, or a mixture of such noble metals. Mixtures and alloys of copper and silver containing up to about 30 wt. % silver are preferred. The silver content is about 0.2–30 wt. %, preferably about 2–30 wt. %, more preferably about 4–20 wt. %, and optimally about 5–10 wt. %, remainder copper. The starting mixture preferably contains about 50–90 parts by weight of the metal oxides and about 10–50 parts by weight of the copper and noble metal.

The alloy or mixture of copper and silver preferably comprises particles having an interior portion containing more copper than silver, and an exterior portion containing more silver than copper. More preferably, the interior portion contains at least about 70 wt. % copper and less than about 30 wt. % silver, while the exterior portion contains at least about 50 wt. % silver and less than about 30 wt. % copper. Optimally, the interior portion contains at least about 90 wt. % copper and less than about 10 wt. % silver, while the exterior portion contains less than about 10 wt. % copper and at least about 50 wt. % silver. If desired, all or part of the silver may be replaced with one or more other noble metals.

The alloy or mixture may be provided in the form of copper particles coated with silver or other noble metal. The noble metal coating may be provided, for example, by electrolytic deposition or electroless deposition, chemical vapor deposition, or physical vapor deposition.

Particles having an average particle size of about 2–100 microns are suitable. The copper interior portion or core comprises about 75–99.8 wt. % and the noble metal exterior portion or coating comprises about 0.2–25 wt. % of the particles. When the particles are copper coated with silver, the copper interior portion preferably comprises about 85–99 wt. % and the silver exterior portion about 1–15 wt. % of the particles.

The starting mixture is treated or sintered at an elevated temperature in the range of about 750–1500° C., preferably about 1000–1400° C. and more preferably about 1300–1400° C. In a particularly preferred embodiment, the sintering temperature is about 1350° C.

The gaseous atmosphere contains about 5–3000 ppm oxygen, preferably about 5–700 ppm and more preferably about 10–350 ppm. Lesser concentrations of oxygen result in a product having a larger metal phase than desired, and excessive oxygen results in a product having too much of the phase containing metal oxides (ceramic phase). The remainder of the gaseous atmosphere preferably comprises a gas such as argon that is inert to the metal at the reaction temperature.

In a preferred embodiment, about 1–10 parts by weight of an organic polymeric binder are added to 100 parts by weight of the metal oxide and metal particles. Some suitable binders include polyvinyl alcohol, acrylic polymers, polyglycols, polyvinyl acetate, polyisobutylene, polycarbonates, polystyrene, polyacrylates, and mixtures and copolymers thereof. Preferably, about 3–6 parts by weight of the binder are added to 100 parts by weight of the metal oxides, copper and silver.

Inert anodes made by the process of our invention have ceramic phase portions and alloy phase portions or metal phase portions. The ceramic phase portions may contain both a ferrite such as nickel ferrite or zinc ferrite, and a metal oxide such as nickel oxide or zinc oxide. The alloy phase portions are interspersed among the ceramic phase portions. At least some of the alloy phase portions include an interior portion containing more copper than noble metal and an exterior portion containing more noble metal than copper. The noble metal is preferably silver.

At least part of the ceramic phase portion should have a spinel structure. Some preferred spinels have the formulas $NiFe_2O_4$, $Ni_{1+x}Fe_{2-x}O_4$, and $Ni_{1-x}Fe_{2+x}O_4$, wherein x is less than about 0.4.

Other suitable spinels have the following formulas:

$Ni_xZn_yFe_{2\pm z}O_4$, wherein x+y is about 0.8–1.2 and z is less than or equal to 0.3;

$Ni_xZn_yFe_mCr_nO_4$, wherein x+y is about 0.8–1.2 and m+n is about 1.5–3; and $Ni_xZn_yFe_mCr_nTa_p\ O_4$, wherein x+y is about 0.8–1.2 and m+n+p is about 1.5–3.

Inert electrodes made in accordance with our invention are preferably inert anodes useful in electrolytic cells for metal production operated at temperatures in the range of about 750–1080° C. A particularly preferred cell operates at a temperature of about 900–980° C., preferably about 950–970° C. An electric current is passed between the inert anode and a cathode through a molten salt bath comprised an electrolyte and an oxide of the metal to be collected. In a preferred cell for aluminum production the electrolyte comprises aluminum fluoride and sodium fluoride and the metal oxide is alumina. The weight ratio of sodium fluoride to aluminum fluoride is about 0.7 to 1.25, preferably about 1.0 to 1.20. The electrolyte may also contain calcium fluoride and/or lithium fluoride.

DETAILED DESCRIPTION OF A PREFERRED EMBODIMENT

Figure 1:
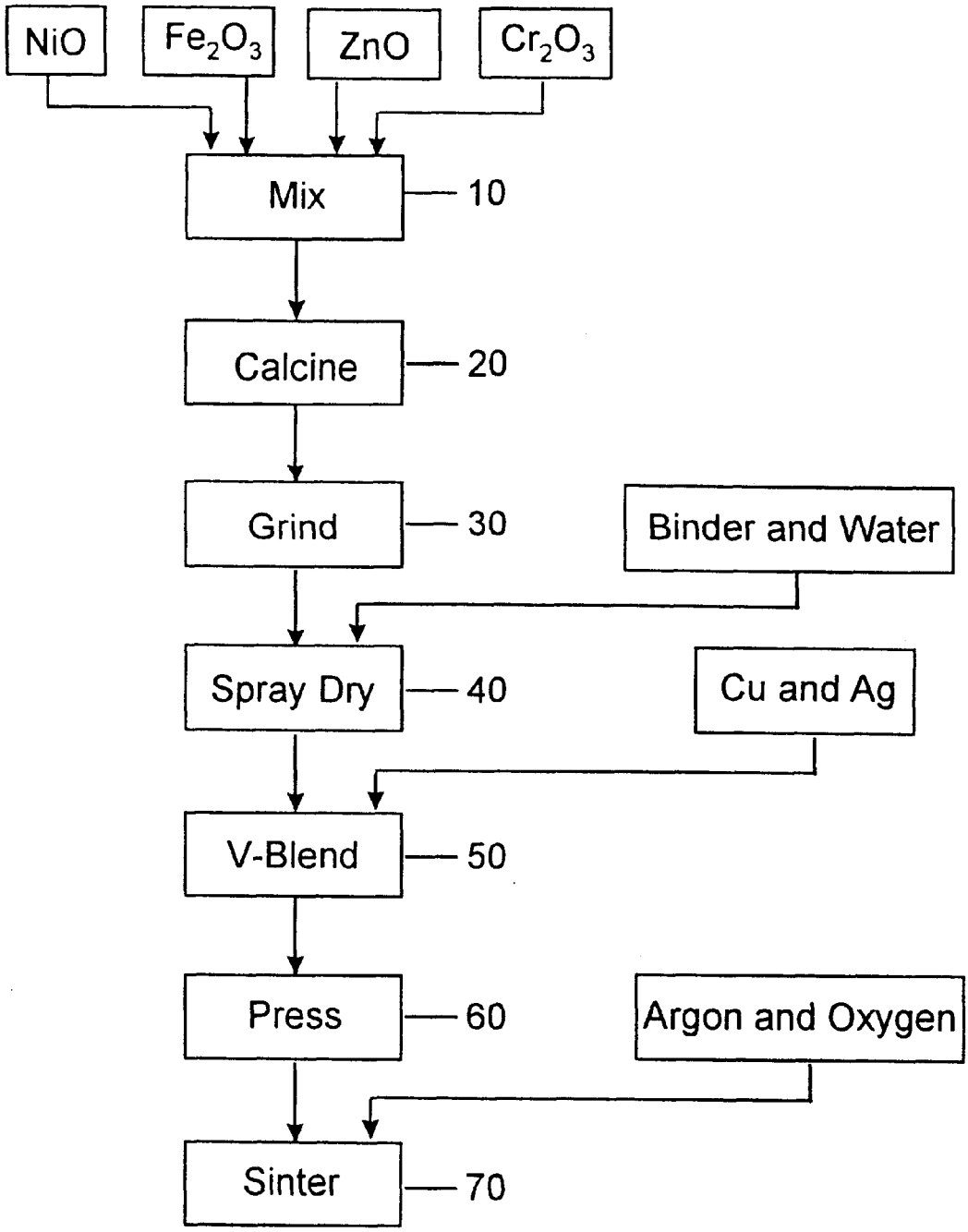
FIG. 1 is a flowsheet diagram of a process for making in inert electrode in accordance with the present invention.

In the embodiment diagramed in FIG. 1, the process of our invention starts by blending NiO and $Fe_2O_3$ powders in a mixer 10. Optionally, the blended powders may be ground to a smaller size before being transferred to a furnace 20 where they are calcined for 12 hours at 1250° C. The calcination produces a mixture having nickel ferrite spinel and NiO phases. If desired, the mixture may include other oxide powders such as ZnO and $Cr_2O_3$.

The mixture is sent to a ball mill 30 where it is ground to an average particle size of approximately 10 microns. The fine particles are blended with a polymeric binder and water to make a slurry in a spray dryer 40. The slurry contains about 60 wt. % solids and about 40 wt. % water. Spray drying the slurry produces dry agglomerates that are transferred to a V-blender 50 and there mixed with copper and silver powders.

The V-blended mixture is sent to a press 60 where it is isostatically pressed, for example at 20,000 psi, into anode shapes. The pressed shapes are sintered in a controlled atmosphere furnace 70 supplied with an argon-oxygen gas mixture. The furnace 70 is typically operated at 1350–1385° C. for 2–4 hours. The sintering process burns out polymeric binder from the anode shapes.

The starting material in one embodiment of our process is a mixture of copper powder and silver powder with a metal oxide powder containing about 51.7 wt. % NiO and about 48.3 wt. % $Fe_2O_3$. The copper powder nominally has a 16 micron average particle size and possesses the properties shown in Table 1.

TABLE 1

Physical and Chemical Analysis of Cu Powder

| | Particle Size (microns) |
|---|---|
| 90% less than | 27.0 |
| 50% less than | 16.2 |
| 10% less than | 7.7 |

Spectrographic Analysis
Values accurate to a factor of ±3

| Element | Amount (wt. %) |
|---|---|
| Ag | 0 |
| Al | 0 |
| Ca | 0.02 |
| Cu | Major |
| Fe | 0.01 |
| Mg | 0.01 |
| Pb | 0.30 |
| Si | 0.01 |
| Sn | 0.30 |

Figure 2:
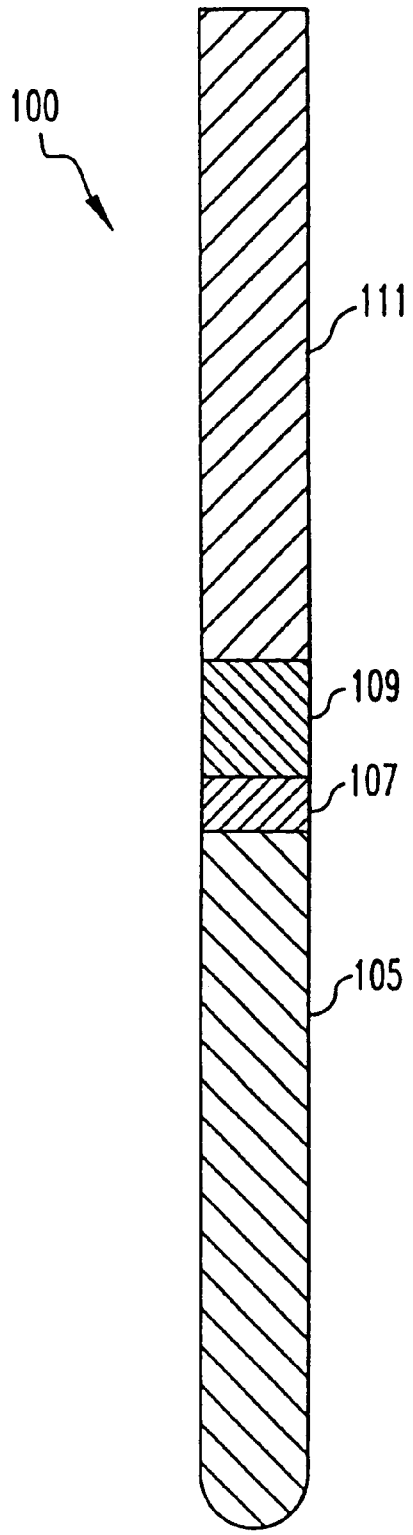
FIG. 2 is a schematic illustration of an inert anode made in accordance with the present invention.

About 83 parts by weight of the NiO and $Fe_2O_3$ powders are combined with 17 parts by weight of the copper and silver powder. As shown in FIG. 2, an inert anode 100 of the present invention includes a cermet end 105 joined successively to a transition region 107 and a nickel end 109. A nickel or nickel- chromium alloy rod 111 is welded to the nickel end 109. The cermet end 105 has a length of 96.25 mm, the transition region 107 is 7 mm long and the nickel end 109 is 12 mm long. The transition region 107 includes four layers of graded composition, ranging from 25 wt. % Ni adjacent the cermet end 105 and then 50, 75 and 100 wt. % Ni, balance the mixture of NiO, $Fe_2O_3$ and copper and silver powders described above.

The anode 10 is then pressed at 20,000 psi and sintered in an atmosphere containing argon and oxygen.

We made several test anodes containing up to 17 wt. % of a mixture of copper and silver powders, balance an oxide powder mixture containing 51.7 wt. % NiO and 48.3 wt. % $Fe_2O_3$. The copper-silver mixture contained either 98 wt. % copper and 2 wt. % silver or 70 wt. % copper and 30 wt. % silver.

These anodes were tested for 7 days at 960° C. in a molten salt bath having an $AlF_3$/NaF ratio of 1.12, along with anodes containing 17 wt. % copper-silver alloy and 83 wt. % of the NiO and $Fe_2O_3$ mixture. At the end of the test, a microscopic examination found that the silver-containing samples had significantly less corrosion and metal phase attack than samples containing copper only. We also observed that samples containing the 70 Cu-30 Ag alloy had better corrosion resistance than samples made with the 98 Cu-2 Ag alloy.

Microscopic examination of the samples made with 70 Cu-30 Ag alloy showed a multiplicity of alloy phase portions or metal phase portions interspersed among ceramic phase portions. Surprisingly, the alloy phase portions each had an interior portion rich in copper surrounded by an exterior portion rich in silver. In one sample made with 14 wt. % silver, 7 wt. % copper, 40.84 wt. %NiO and 38.16 wt. % $Fe_2O_3$, a microprobe x-ray analysis revealed the following metal contents in one alloy phase portion.

TABLE 2

Contents of Alloy Phase

| | Metal Content (wt. %) | | | |
|---|---|---|---|---|
| | Ag | Cu | Fe | Ni |
| Interior portion | 3.3 | 72 | 0.8 | 23 |
| Exterior portion | 90+ | 6 | 1.5 | 1.7 |

Figure 3:
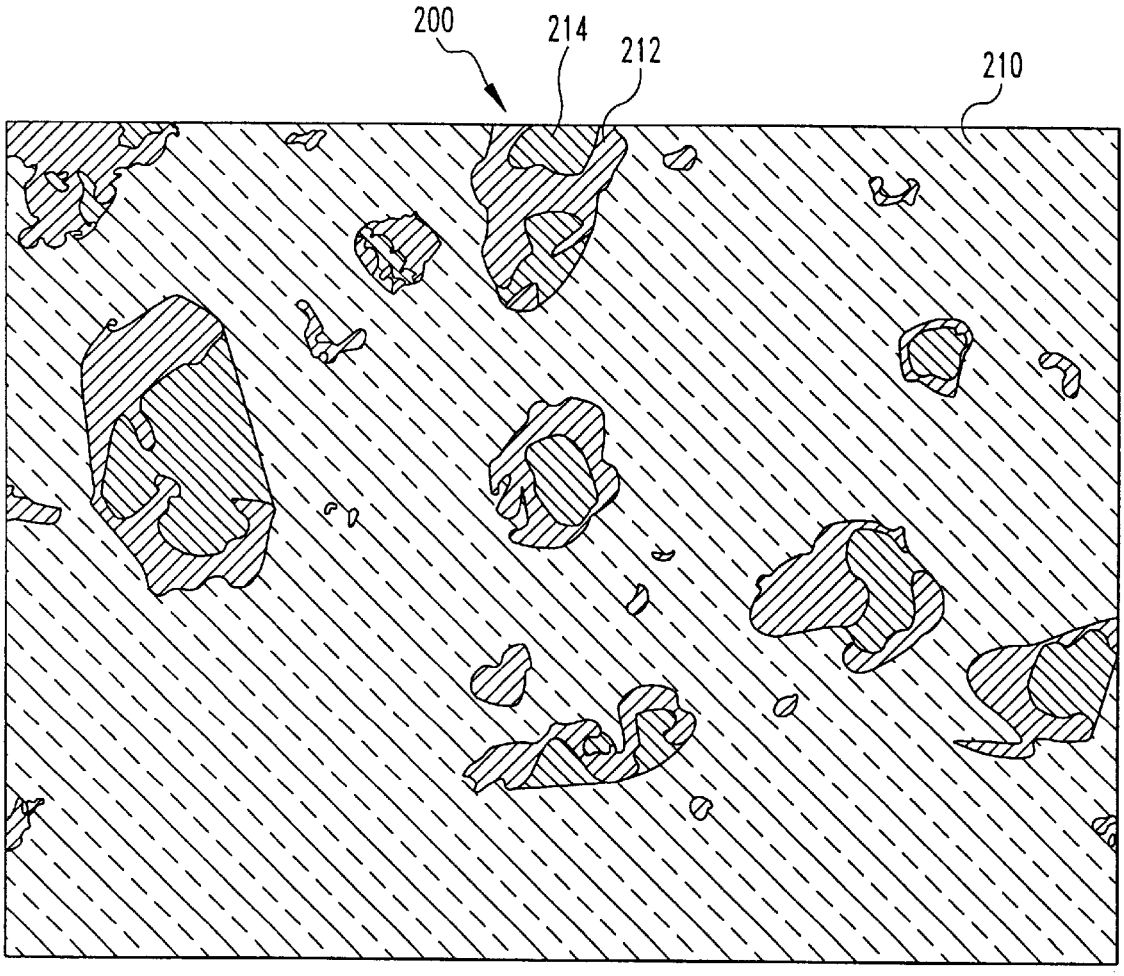
FIG. 3 is a schematic illustration of the microstructure of an inert electrode of the invention.

An anode made with 14 wt. % silver, 7 wt. % copper, 40.84 wt. % NiO and 38.16 wt. % $Fe_2O_3$ was cross-sectioned for x-ray analysis. An x-ray backscatter image taken at 494× is shown schematically in FIG. 3. Several lighter colored metal phase portions or alloy phase portions 200 are seen scattered in a ceramic matrix or ceramic phase portion 210. The metal phase portions 200 include light exterior portions 212 containing more silver than copper, generally surrounding darker interior portions 214 containing more copper than silver.

We prepared several inert anode compositions in accordance with the procedures described above. These compositions were evaluated in a Hall-Heroult test cell operated for 100 hours at 960° C., with a bath ratio of 1.1 and alumina concentration maintained at about 7–7.5 wt. %. The anode compositions and impurity concentrations in aluminum produced by the cell are shown in Table 3. Some of the impurities were from sources other than the inert anode compositions.

TABLE 3

100 Hour Inert Anode Test

| Inert Anode Composition (wt. %) | | | | Impurity Concentration (wt. %) | | | |
|---|---|---|---|---|---|---|---|
| Ag | Cu | NiO | $Fe_2O_3$ | Fe | Cu | Ni | Ag |
| 3 | 14 | 42.9 | 40.1 | 0.191 | 0.024 | 0.044 | 0 |
| 3 | 14 | 42.9 | 40.1 | 0.26 | 0.012 | 0.022 | 0 |
| 3 | 14 | 26.45 | 56.55 | 0.375 | 0.13 | 0.1 | 0.015 |
| 3 | 14 | 42.9 | 40.1 | 0.49 | 0.05 | 0.085 | 0.009 |
| 3 | 14 | 42.9 | 40.1 | 0.36 | 0.034 | 0.027 | 0.004 |
| 5 | 10 | 43.95 | 40.05 | 0.4 | 0.06 | 0.19 | 0.025 |
| 3 | 14 | 42.9 | 40.1 | 0.38 | 0.095 | 0.12 | 0.0002 |
| 2 | 15 | 42.9 | 40.1 | 0.5 | 0.13 | 0.33 | 0.02 |
| 2 | 15 | 42.9 | 40.1 | 0.1 | 0.16 | 0.26 | 0.01 |
| 3 | 11 | 44.46 | 41.54 | 0.14 | 0.017 | 0.13 | 0.003 |
| 1 | 14 | 27.75 | 57.25 | 0.24 | 0.1 | 0.143 | 0.007 |

The results in Table 3 show low levels of metal contamination by the inert anodes. In addition, the inert anode wear rate was less than 1.5 inch per year in each We have discovered that sintering anode compositions in an atmosphere of controlled oxygen content lowers the porosity to acceptable levels and avoids bleed out of the metal phase. The atmosphere we used in tests with a mixture containing 83 wt. % NiO and $Fe_2O_3$ powders and 17 wt. % copper powder was predominantly argon, with controlled oxygen contents in the range of 17 to 350 ppm. The anodes were sintered in a Lindbergh tube furnace at 1350° C. for 2 hours. We found that anode compositions these conditions always had less than 0.5% porosity, and that density was approximately 6.05 g/cm$^3$ when the compositions were sintered in argon containing 70–150 ppm oxygen. In contrast, when the same anode compositions were sintered for the at the same temperature in an argon atmosphere, porosities ranged from about 0.5 to 2.8% and the anodes showed various amounts of bleed out of the copper-rich metal phase.

We also discovered that nickel and iron contents in the metal phase of our anode compositions can be controlled by adding an organic polymeric binder to the sintering mixture. Some suitable binders include polyvinyl alcohol (PVA), acrylic acid polymers, polyglycols such as polyethylene glycol (PEG), polyvinyl acetate, polyisobutylenes, polycarbonates, polystyrenes, polyacrylates and mixtures and copolymers thereof.

A series of tests was performed with a mixture comprising 83 wt. % of metal oxide powders and 17 wt. % copper powder. The metal oxide powders were 51.7 wt. % NiO and 48.3 wt. % $Fe_2O_3$. Various percentages of organic binders were added to the mixture, which was then sintered in a 90 ppm oxygen-argon atmosphere at 1350° C. for 2 hours. The results are shown in Table 4.

TABLE 4

Effect of Binder Content on Metal Phase Composition

| | | Metal Phase Composition | | |
|---|---|---|---|---|
| Binder | Binder Content (wt. %) | Fe (wt. %) | Ni (wt. %) | Cu (wt. %) |
| 1 PVA | 1.0 | 2.16 | 7.52 | 90.32 |
| Surfactant | 0.15 | | | |
| 2 PVA | 0.8 | 1.29 | 9.2 | 89.5 |
| Acrylic Polymers | 0.6 | | | |
| 3 PVA | 1.0 | 1.05 | 10.97 | 87.99 |
| Acrylic Polymers | 0.9 | | | |
| 4 PVA | 1.1 | 1.12 | 11.97 | 86.91 |
| Acrylic Polymers | 0.9 | | | |
| 5 PVA | 2.0 | 1.51 | 13.09 | 85.40 |
| Surfactant | 0.15 | | | |
| 6 PVA | 3.5 | 3.31 | 32.56 | 64.13 |
| PEG | 0.25 | | | |

The test results in Table 4 show that selection of the nature and amount of binder in the mixture can be used to control composition of the metal phase in the cermet. We prefer a binder containing PVA and either a surfactant or acrylic powder in order to raise the copper content of the metal phase. A high copper content is desirable in the metal phase because nickel anodically corrodes during electrolysis.

Having thus described the invention, what is claimed is:

1. A process for making a cermet composite material suitable for use in an inert electrode for production of a metal by electrolytic reduction in a molten salt bath, comprising treating at an elevated temperature and in an atmosphere containing oxygen, a starting mixture comprising:

(a) a compound of iron and a compound of at least one other metal selected from the group consisting of nickel, tin, zinc, yttrium, chromium, and tantalum; and (b) an alloy or mixture of copper and a noble metal selected from the group consisting of silver, gold, platinum, palladium, rhodium, and iridium, said alloy or mixture containing more of the copper than the noble metal.

2. The process of claim 1 wherein said treating produces a cermet composite including a ceramic phase portion comprising oxides of iron and at least one said other metal, and an alloy phase portion comprising copper and at least one said noble metal.

3. The process of claim 1 wherein said starting mixture comprises iron oxide, nickel oxide, and an oxide of at least one other metal selected from the group consisting of zinc, chromium, and tantalum.

4. The process of claim 1 wherein said starting mixture comprises about 50–90 parts by weight of said compound of iron and said compound of said other metal, about 10–50 parts by weight of said alloy or mixture, and about 2–10 parts by weight of an organic polymeric binder.

5. The process of claim 1 wherein said compound of iron and said compound of said other metal both comprise particles.

6. The process of claim 5 wherein said particles have an average particle size of about 100 microns or less.

7. The process of claim 1 wherein the starting mixture is treated at a temperature in the range of about 750–1500° C. in an atmosphere containing up to about 300 ppm oxygen.

8. A cermet composite material made by the process of claim 1.

9. An inert anode suitable for use in a molten salt bath, said inert anode being made by treating at an elevated temperature, in the presence of oxygen, a mixture comprising:

(a) a compound of iron and a compound of at least one other metal selected from the group consisting of nickel, tin, zinc, yttrium, zirconium, chromium, and tantalum; and (b) an alloy or mixture containing about 70–99.8 wt. % copper and about 0.2–30 wt. % of at least one noble metal selected from the group consisting of silver, gold, platinum, palladium, rhodium, and iridium, said inert anode comprising at least one ceramic phase portion comprising iron oxide and at least one oxide of said other metal, and a plurality of alloy phase portions comprising copper and at least one said noble metal.

10. The inert anode of claim 9 wherein said alloy or mixture contains about 2–30 wt. % silver and about 70–98 wt. % copper.

11. The inert anode of claim 9 wherein said mixture comprises about 50–90 parts by weight oxides of iron and said other metal, and about 10–50 parts by weight copper and silver.

12. The inert anode of claim 9 wherein at least part of said ceramic phase portion has a spinel structure.

13. The inert anode of claim 12 wherein said spinel structure includes oxides of iron and at least one other metal selected from the group consisting of nickel, zinc, chromium, and tantalum.

14. The inert anode of claim 12 wherein said spinel structure has the formula $(Ni_xZn_y)\ Fe_{2\pm z}O_4$ wherein x+y is about 0.8–1.2 and z is less than or equal to 0.3.

15. The inert anode of claim 12 wherein said spinel structure has the formula $Ni_xZn_y\ (Fe_mCr_n)\ O_4$ wherein x+y is about 0.8–1.2 and m+n is about 1.5–3.

16. The inert anode of claim 12 wherein said spinel structure has the formula $Ni_xZn_y\ Fe_mCr_nTa_pO_4$ wherein x+y is about 0.8–1.2 and m+n+p is about 1.5–3.

17. An electrolytic cell for producing aluminum in a process wherein oxygen is evolved, comprising:

(a) a molten salt bath comprising an electrolyte and alumina;

(b) a cathode; and (c) an anode comprising the inert anode of claim 9.

18. The electrolytic cell of claim 17 wherein said molten salt bath comprises aluminum fluoride and sodium fluoride.

19. An electrolytic process for producing metal by passing a current between an anode and a cathode through a molten salt bath comprising an electrolyte and an oxide of a metal to be collected, said anode comprising the inert anode of claim 9.

20. The process of claim 19 wherein said oxide comprises alumina.

* * * * *